United States Patent [19]

Jankovsky

[11] Patent Number: 4,936,355

[45] Date of Patent: Jun. 26, 1990

[54] WEFT MIXER FOR A LOOM

[75] Inventor: Frantisek Jankovsky, Winterthur, Switzerland

[73] Assignee: Sulzer Brothers Limited, Winterthur, Switzerland

[21] Appl. No.: 339,068

[22] Filed: Apr. 14, 1989

[30] Foreign Application Priority Data

Apr. 25, 1988 [CH] Switzerland ..... 01535/88

[51] Int. Cl.[5] ..... D03D 47/38

[52] U.S. Cl. ..... 139/453; 139/439

[58] Field of Search ..... 112/453, 439, 437, 438

[56] References Cited

U.S. PATENT DOCUMENTS

| | | | |
|---|---|---|---|
| 3,528,459 | 9/1970 | Pfarrwaller | 139/122 |
| 4,556,089 | 12/1985 | Juillard | 139/453 |
| 4,667,705 | 5/1987 | Nijhuis | 139/439 |
| 4,781,226 | 11/1988 | Moeneclaey et al. | 139/453 |
| 4,840,203 | 6/1989 | Moeneclaey et al. | 139/453 |

FOREIGN PATENT DOCUMENTS

| | | |
|---|---|---|
| 0714188 | 10/1968 | Belgium . |
| 0716984 | 12/1968 | Belgium . |
| 0190798 | 8/1986 | European Pat. Off. . |
| 1236464 | 6/1971 | United Kingdom . |

*Primary Examiner*—Andrew M. Falik

*Attorney, Agent, or Firm*—Kenyon & Kenyon

[57] ABSTRACT

The weft change motion employs a connecting link between a reciprocating mixer lever and a pivotally mounted mixer segment. During normal alternating weft changing, the link moves from one end position through a neutral position and, under the inertia forces moves towards a second end position. The oscillating movement of the link permits the change motion to alternately feed weft yarns. In order to permit picking of the same weft yarn, a locking device is provided to prevent the oscillating link from moving past the neutral position. The locking device also serves to return the link to the same end position so that the same weft yarn can be picked. Various forms of locking devices can be used including an electromagnet, a movably mounted slide block with an appropriately shaped slot and a slide block employing a rotating disk having an appropriately shaped opening to receive a slide pin.

21 Claims, 9 Drawing Sheets

WEFT MIXER FOR A LOOM

This invention relates to a weft change motion for a loom.

Heretofore, various weft change motions have been constructed, for example, for looms, wherein a plurality of weft givers can be selectively moved into a picking position for the picking of different yarns into a shed of warp yarns. Change motions for just two weft colors have been known in weaving as weft mixers. In such cases, the weft change program has been very restricted. In the simplest case, two weft yarns are picked alternately, the change motion moving alternately from one position to the other. Weft mixers were developed from multiweft devices to ensure, in the case of single-color fabric, a very uniform cloth in which the change from one package to another is less noticeable.

A multiweft device for four weft colors has been described, for example, in European Patent Application No. 0190798 as well as in German Pat. No. 1,710,356 and in corresponding U.S. Pat. No. 3,528,459. Important elements of this device are used for a weft change motion very commonly found in projectile looms to provide for a change of two weft colors. However, the weft change motions which have been used have been relatively cumbersome and heavy. For example, in some cases, the weft change motion has relied upon a crank eccentric in order to effect a weft change. In addition, a pivotally mounted mixture segment on which weft givers are mounted has been constructed to cooperate with abutments and/or a locking lever which engages in recess in the mixer segment in order to provide for an accurate positioning of the mixer segment for a weft change. The mechanical complexity of such a weft change motion is considerable and attainable speeds are limited, inter alia, because of impact stressing in the motion. Accordingly, it is an object of the invention to provide a weft change motion which has a reduced number of mechanical connections with play and of individual parts.

It is another object of the invention to provide a weft change motion which operates without impact stressing.

It is another object of the invention to provide a weft change motion of light weight construction.

It is another object of the invention to construct a weft change motion with a minimum of parts.

Briefly, the invention provides a weft change motion for a loom which is comprised of a means for selectively moving one of at least two weft givers into a picking position, an actuating means reciprocably mounted between a pair of end positions and a connector interconnected to and between the actuating means and the means for moving the weft givers in order to transfer a moving force from the actuating means to the means for moving the weft givers. The connector is disposed to move into and through a neutral position during movement of the actuating means between the end positions thereof under the inertia of the means for moving the weft givers to effect an alternate feed of the weft yarns.

The means for moving the two weft givers may be in the form of a mixer segment which is pivotally mounted about a pivot axis with the weft givers at one end. Where the mixer segments carries two weft givers, the segment is pivotable between two positions so as to position each weft giver in a picking position.

The actuating means may be in the form of a cam transmission, for example driven off the main shaft of the loom.

The connector may be in the form of a link which is pivotably connected on a pivot axis to the actuating means and pivotably connected on a second pivot axis to the mixer segment. When in a neutral position, the two pivot axes of the link are disposed in a common plane with the pivot axis of the mixer segment. Thus, during reciprocation of the actuating means between the end positions thereof, the link moves into and through a position which is neutral relative to the actuating means.

The weft change motion also has a second actuating means pivotally connected to the mixer segment or the connecting link in order to act on the mixer segment at least in the neutral position of the link. This actuating means is provided for positioning the mixer segment for a return movement into the position just vacated in response to a subsequent movement of the first actuating means.

The second actuating means may take various forms. For example, in one embodiment, this actuating means is in the form of a controllable magnet which is effective in two directions. In another embodiment, this actuating means includes a slide block which is movable into a plurality of positions and which has a plurality of zones corresponding to these positions. In addition, a slide pin which is secured to the mixer segment, for example via a lever arm, is guided within a selected zone of the slide block in order to inhibit movement of the segment from one position thereof to another position or to permit movement. In still another embodiment, a circular disc can be rotatably mounted in the slide block to receive the pin in a suitable recess to provide for the various movements of the pin and thus the mixer segment.

It is to be noted that the actuating means is necessary for slow running of a loom in order to ensure that the oscillating link does not stick in the neutral position and block the motion. However, if the loom runs fast, the oscillating link can overcome the neutral position due to the mass inertia of the link. In this case, the second actuating means would not be required.

These and other objects and advantages of the invention will become more apparent from the following detailed description taken in connection with the accompanying drawings wherein.

Figure 9A:
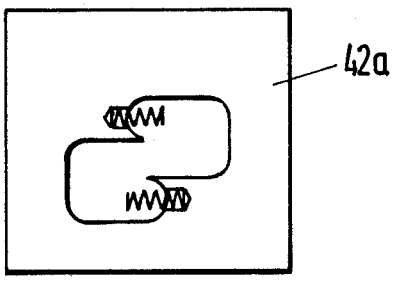
Figure 9B:
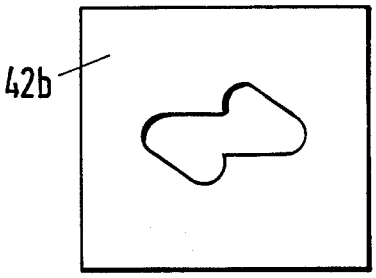
Figure 9C:
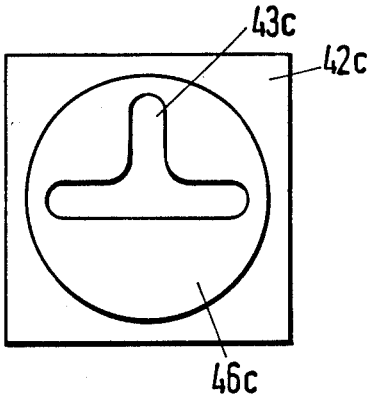
Figure 9D:
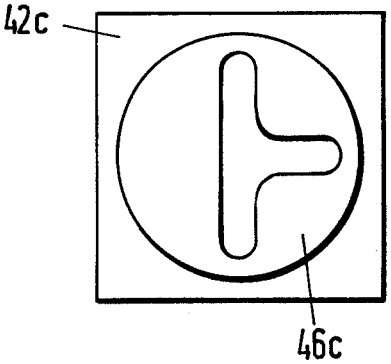
Figure 9E:
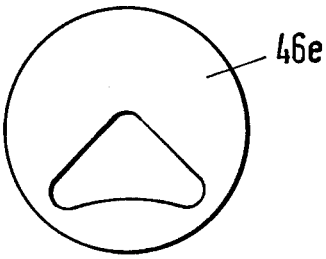
Figure 9F:
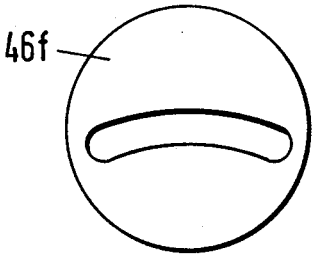
Figures 10A, 10B, 10C:
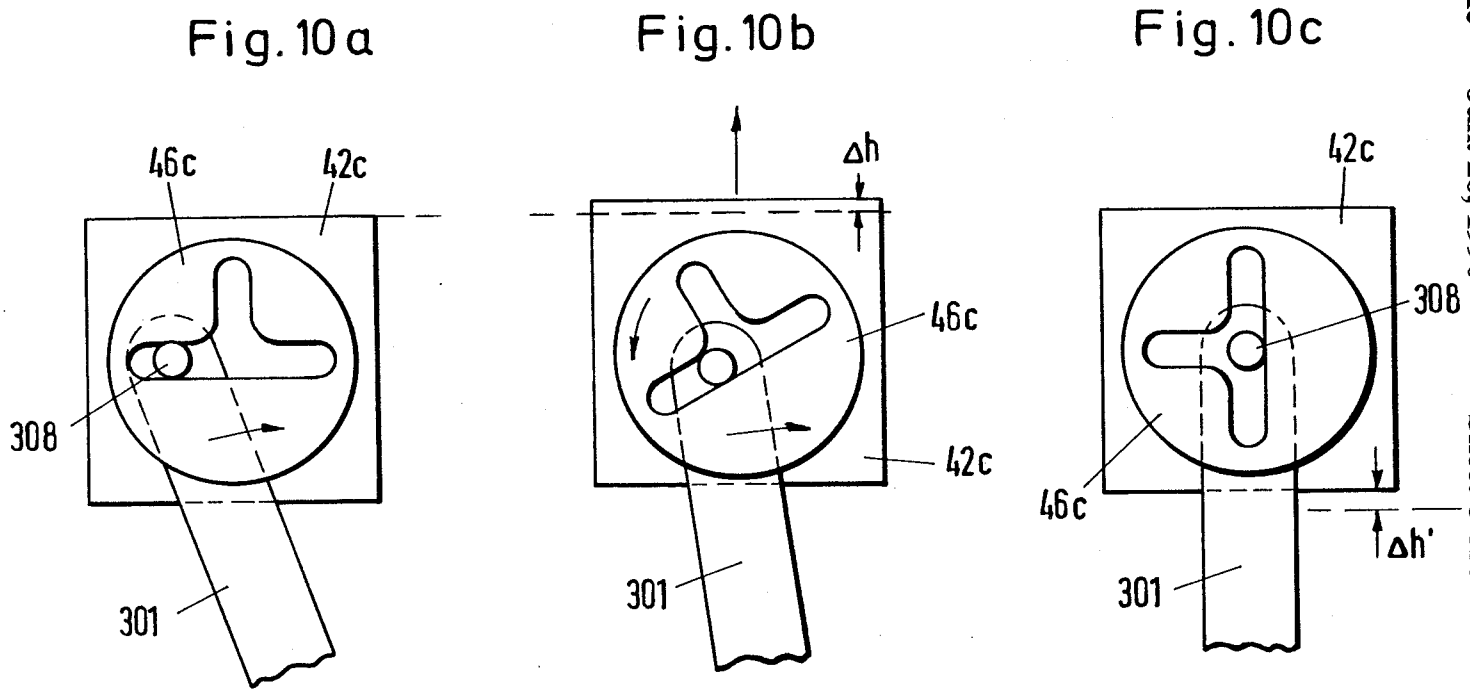
Figure 11:
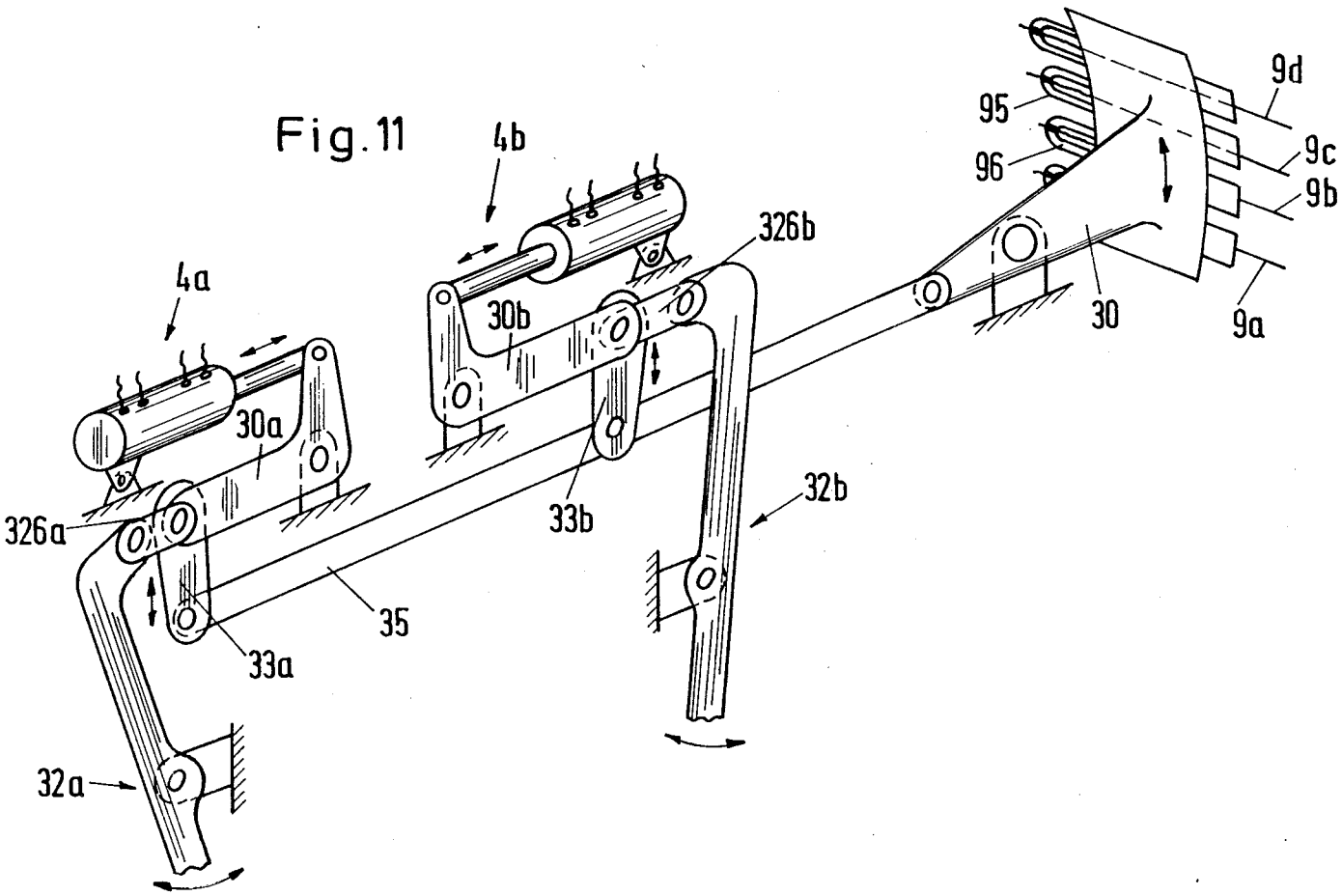

FIG. 9*a* illustrates a front view of a slide block having a modified recess in accordance with the invention;

FIG. 9*b* illustrates a front view of a further modified slide block in accordance with the invention;

FIG. 9*c* illustrates a front view of a slide block having a rotatable disc with a recess in accordance with the invention;

FIG. 9*d* illustrates a view of the slide block of FIG. 9*c* with the disc turned 90°;

FIG. 9*e* illustrates a front view of a rotatable disc having a modified recess in accordance with the invention;

FIG. 9*f* illustrates a front view of a rotatable disc with a further modified recess in accordance with the invention;

FIG. 10*a* illustrates a front view of the slide block of FIG. 9*c* in a position to permit a reciprocating motion of a mixer segment;

FIG. 10*b* illustrates a front view of a position of the rotatable disc of FIG. 10*a* during movement toward a neutral position of a connecting link;

FIG. 10*c* illustrates a front view of the position of the rotatable disc of FIG. 10*a* in a position to impede reciprocation of the mixer segment in accordance with the invention; and FIG. 11 illustrates a schematic view of a weft change motion for four weft colors in accordance with the invention.

Figure 1:
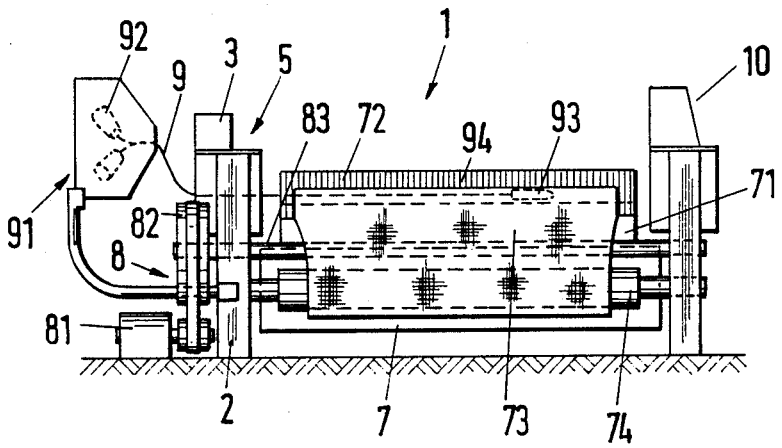
FIG. 1 illustrates a diagrammatic view of a loom having a weft change motion in accordance with the invention.

Referring to FIG. 1, the loom 1 has a frame 2 on which a weft change motion 3 is mounted adjacent a picking device 5. In addition, a package frame 91 is mounted to the side of the frame 2 and includes a plurality of weft packages 92 from which weft yarn 9 can be drawn off towards the picking device 5. A suitable projectile 93 is provided to grip a weft yarn 9 and to be picked by the picking device 5 across the loom within a shed formed by a plurality of warp yarns 71 which are paid off a warp beam 7 and controlled by heald frames 72. The finished cloth 73 is wound on a cloth beam 74 which is also mounted in the frame 2.

A drive 8 which comprises, inter alia, an electric motor 81, a fly wheel 82 and a main shaft 83 coordinates the mechanical functions of the loom 1. In addition, a control unit 10 mounted on the opposite side of the loom frame monitors the various loom functions and is responsible for coordinating loom movements which have to be controlled.

Figure 2:
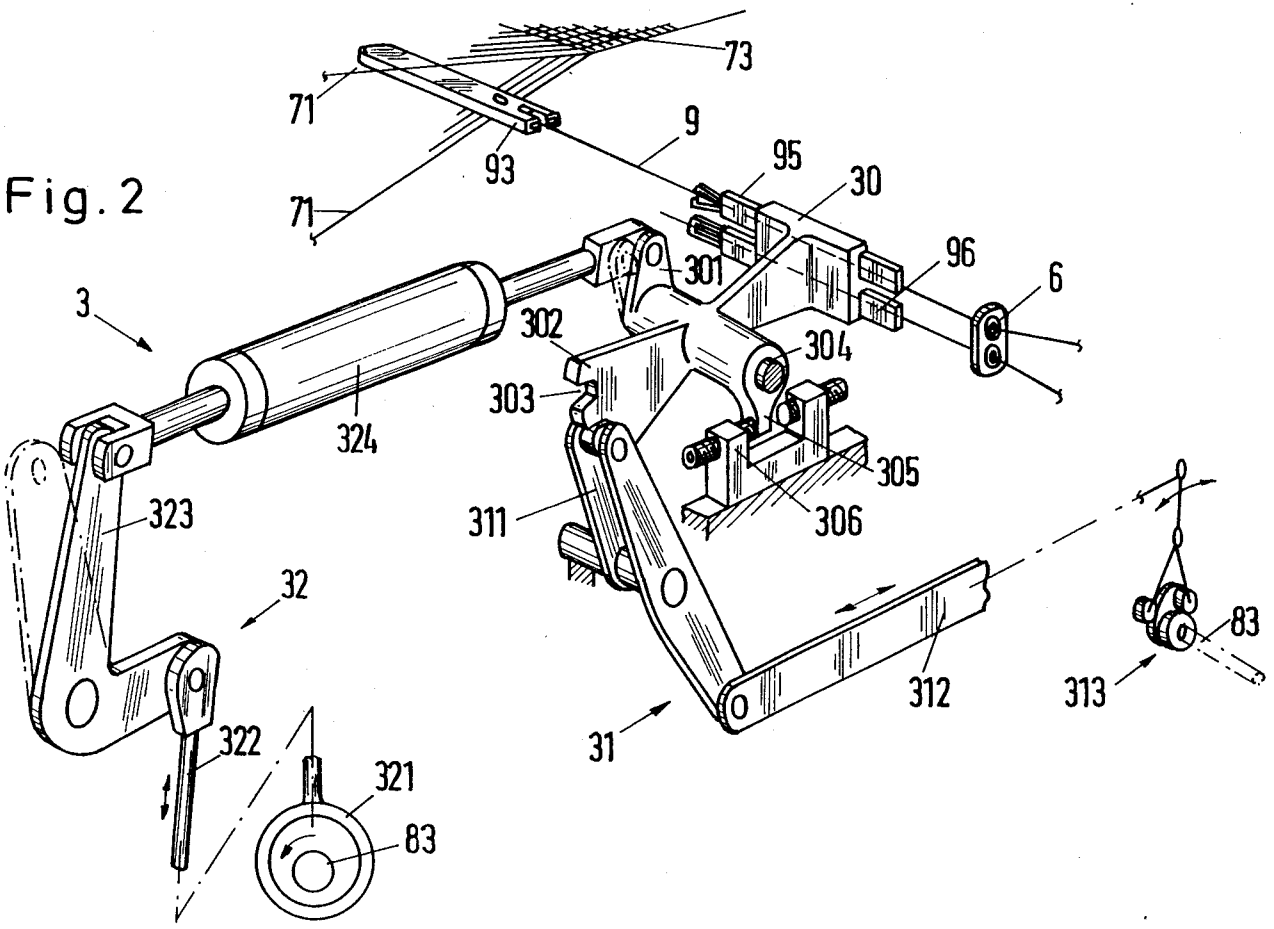
FIG. 2 illustrates a schematic view of a weft change motion in accordance with the prior art.

Referring to FIG. 2, the known weft yarn motion 3 is constructed as a weft mixer for alternately presenting to a projectile 93 one or another of two weft types 9 which move through guide eyes 6 to a mixer segment 30 of the motion. As indicated, the mixer segment 30 has a pair of yarn givers 95, 96 mounted therein for movement into a picking position in registration with the projectile 93. Of note, the weft change motion is illustrated in a position shortly after the start of picking, that is, with the projectile 93 entering a shed between the warp yarns 71. During weft yarn transfer, the projectile 93 is disposed immediately before the giver 95.

The mixer segment 30 is actuated by way of an actuating means 32 which is reciprocably mounted between a pair of end positions. This actuating means 32 includes an eccentric 321 which is mounted about the main shaft 83 which, in turn, is connected to a rod 322 pivotally connected to a bent lever 323. The lever 323 is pivotally mounted and is attached at the opposite end to a spring element 324 which, in turn, is connected to an arm 301 secured to the mixer segment 30. Thus, upon rotation of the main shaft 83, the eccentric 321 causes the rod 322 to reciprocate in the directions indicated by the double arrow. This, in turn, causes the lever 23 to oscillate and, in turn, causes the mixer segment 30 to pivot between two positions.

In order to obtain an accurate positioning of the mixer segment in each of its end positions, the back of the segment 30 has a locking plate 302 provided with grooves 303 engageable by a locking lever 311 of a locking device 31. As indicated, the locking device 31 is driven off the main shaft 83 or a subsidiary shaft (not shown) connected with the main shaft 83 by a transmission employing a reciprocable rod 312 and a cam drive 313. Thus, the transmission serves to move a locking device 31 from the locking position shown into a second position during the time that the mixer segment 30 is moving. In this respect, the lever 311 releases the segment only after the actuating means 32 has moved past its center position. The mixer segment 30, therefore, has a pause or rest during which, inter alia, the giver 95 or 96 transfers a weft yarn to a projectile 93. During this time, the spring element 324 stores some of the working stroke of the actuating means 32 while the segment 30 is kept locked by the locking device 31.

When the segment 30 is in the respective end positions, a depending stop lever 305 engages with a stop 306 to thus obviate further oscillation of the segment 30 in the end position.

As illustrated, the segment 30 is mounted about a pivot shaft 304.

When the weft change motion is required to operate to a pattern program in which the weft yarns are to be picked in any desired sequence, a mechanism, for example, as described in U.S. Pat. No. 3,528,459, is necessary in which a number of actuating means 32 act jointly and simultaneously on the mixer segment 30.

Figure 3:
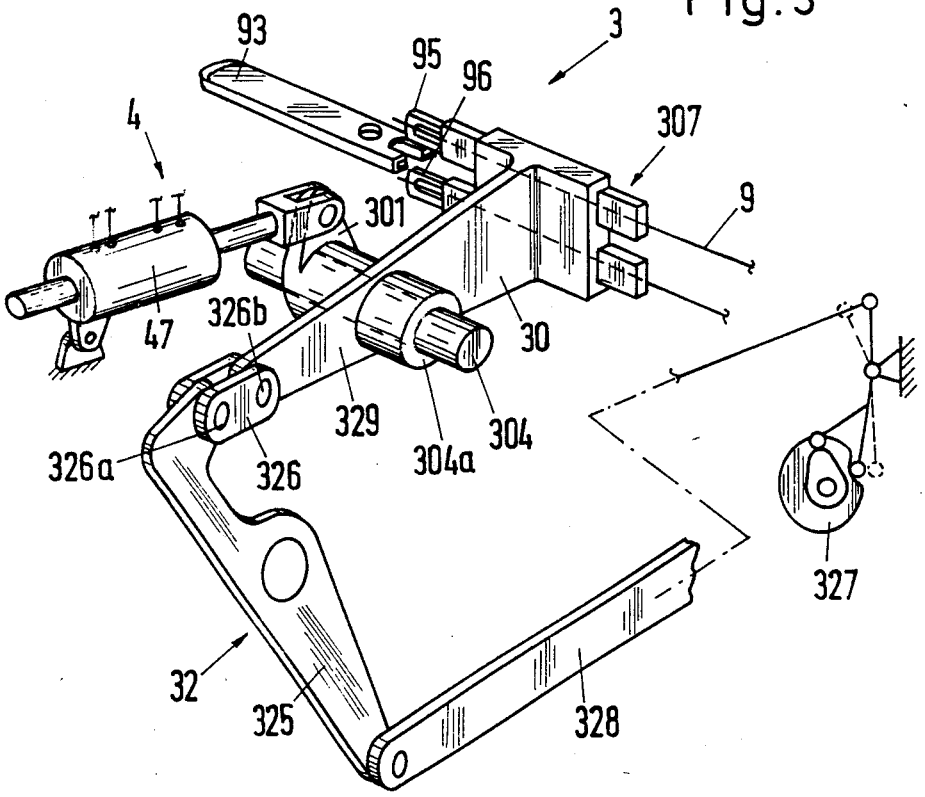
FIG. 3 illustrates a schematic view of a weft change motion constructed in accordance with the invention.

Referring to FIG. 3, the weft change motion may be constructed without a spring element and with a direct connection between an actuating means 32 and a mixer segment 30.

As shown in FIG. 3, the weft change motion employs a means such as a pivotally mounted mixer segment 30 for selectively moving each of two weft givers 95, 96 into a picking position. As indicated, the mixer segment 30 has a yoke 307 to mount the weft givers 95, 96 and is pivotally mounted via a hub 304*a* about a pivot axis formed by a pivot shaft 304. The mixer segment 30 is movable into one of two end positions in each of which a weft giver 95, 96 is in a picking position aligned with a projectile 93.

The actuating means 32 is also reciprocally mounted between a pair of end positions. In this respect, the actuating means 32 includes a pivotally mounted mixer lever 325 which is pivotally connected to a rod 328 which is driven by a cam transmission 327, for example, driven off the main shaft (not shown) of the loom.

In addition, the weft change motion includes a connector in the form of a link 326 which is pivotally connected to and between the actuating means 32 and the mixer segment 30 for transferring a moving force from the actuating means 32 to the mixer segment 30 in order to move the mixer element about the pivot axis defined by the shaft 304. As indicated, the connector 326 is in the form of a pair of links 326, each of which is connected by a bearing pin 326*a* to the end of the lever 325 and by a bearing pin 326*b* to an arm 329 of the mixer segment 30.

Figure 6:
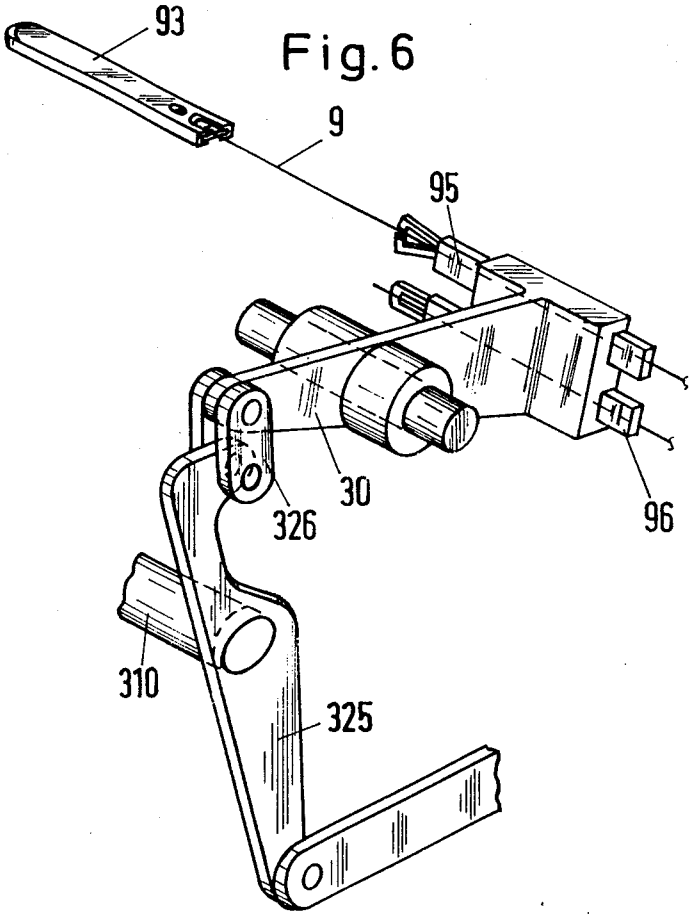
FIG. 6 illustrates a schematic view of the weft change motion of FIG. 3 in a second picking position in accordance with the invention.
Figure 5:
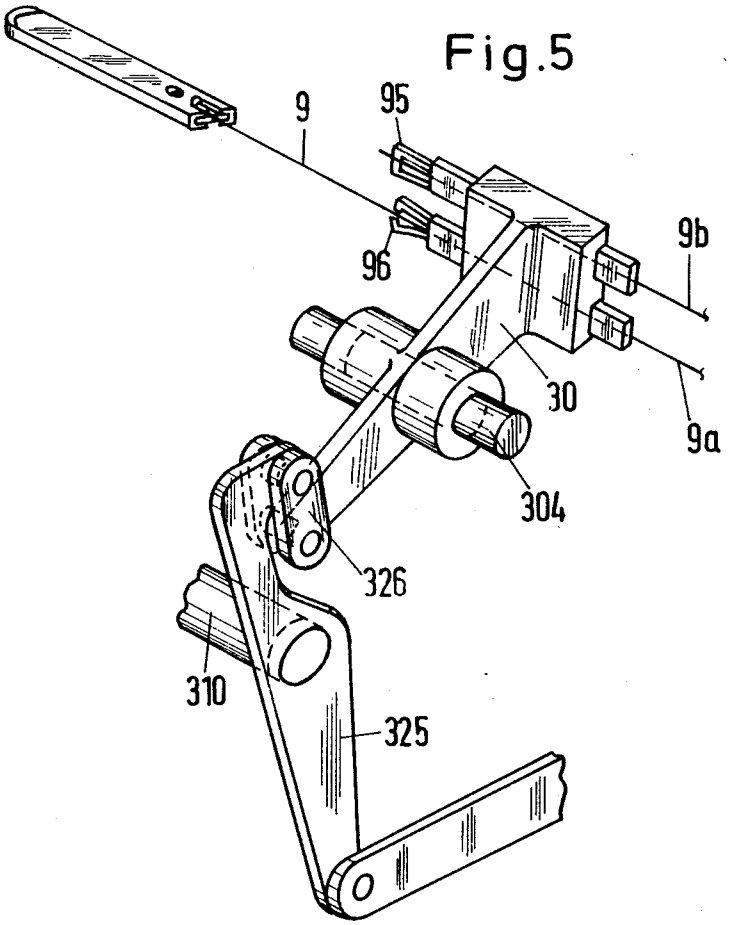
FIG. 5 illustrates a schematic view of of the weft change motion of FIG. 3 in one picking position.

The weft change motion is shown in FIG. 3 in a neutral position of the link 326 during movement of the actuating means 32. FIGS. 5 and 6 illustrate the two possible end positions of the mixer segment 30. In each case, the mixer lever 325 which is mounted on a pivot shaft 310 is in the same position during weft changing. For example, from the position shown in FIG. 5 to the position shown in FIG. 6, the links 326 pass through the neutral position of FIG. 3 because of their own mass inertia and of the mass inertia of the mixer segment 30 together with the givers 95, 96 which can move in guides of the segment 30.

Referring to FIGS. 5 and 6, wherein like reference characters indicate like parts as above, for a weft change operation wherein alternating weft yarns 9*a*, 9*b* are to be fed to a projectile 93, the weft change motion operates as follows.

After picking of the lower weft yarn 9*a* (FIG. 5), the mixer lever 325 is pivoted in a counter-clockwise manner such that the oscillating links 326 pivot in a counter clockwise manner, as viewed passing through the neutral position. Due to the inertia of the links 326 and of the mixer segment 30 and weft givers 95, 96, the links 326 continue towards the position indicated in FIG. 6. Next, upon clockwise pivoting of the mixer lever 325, the links 326 move into the position shown with the mixer segment 30 taking up a position to feed the weft yarn from the weft giver 95 to the projectile 93. Thereafter, as the mixer lever 325 again rotates counter-clockwise, the links 326 pivot clockwise towards the position shown in FIG. 5 and, thereafter, take up the position shown in FIG. 5 when the lever 325 again pivots in a clockwise manner. This sequence continues in alternating manner.

Figure 4:
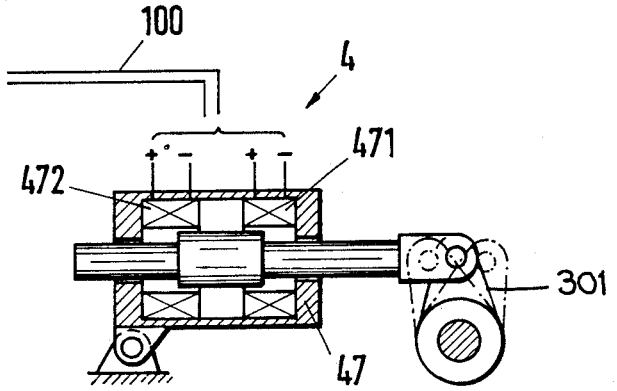
FIG. 4 illustrates a cross sectional view of an actuating means of the weft change motion of FIG. 3 which employs a controllable magnet.

Referring to FIG. 3, a second actuating means 4 is also provided to selectively apply a force to the mixer segment 30 when the links 326 are in the neutral position in order to impede movement of the weft segment 30 in the event that the weft pattern is to be changed. This second actuating means 4 serves to overcome the inertia forces generated by the links 326 and mixer segment 30 upon reaching of the neutral position of the links 326. As illustrated, the actuating means 4 includes a double acting magnet 47 which is connected to a bracket 301 on the hub 304*a* of the mixer element 30. As indicated in FIG. 4, the magnet 47 has a reciprocally mounted armature connected to the bracket 301 which is controlled by a pair of windings 471, 472. The magnet 47 can be energized by way of wiring 100 connected to the loom control 10 see FIG. 1).

When the loom is in operation, the lever 325 reciprocates once per weaving cycle and, during picking is in the end positions shown in FIGS. 5 and 6.

If the same weft yarn (color), for example the weft yarn 9*a* of FIG. 5 is to be picked in a number of weaving cycles, the second actuating means 4 must ensure that, during the oscillation of the lever 325, the links 326 are is not pivoted upwardly from the position shown in FIG. 5 into the position shown in FIG. 6. To this end, as the mixer segment 30 moves downwardly, i.e. clockwise in FIG. 5, the bracket 301 pivots from the left-hand dotted line position shown in FIG. 4 to the solid line neutral position shown in FIG. 4. At this point, the windings 471, 472 impose a force on the armature which is sufficient to overcome the inertia forces of the links 326 and mixer segment 30 so as to preclude further movement thereof. When the mixer lever 325 then begins to pivot clockwise as viewed in FIG. 5, the windings 471, 472 of the electromagnet 47 pulls the bracket 301 into the left-hand dotted line position shown in FIG. 4 so that the links 325 move into the lowered position shown in FIG. 5. That is, the links 325 redescend from the neutral position and the mixer segment 30 re-ascends into the picking position for the weft yarn 9*a*.

The weft change motion thus provides a controlled weft changing with a considerably reduced outlay as compared with previously known motions.

Figure 7:
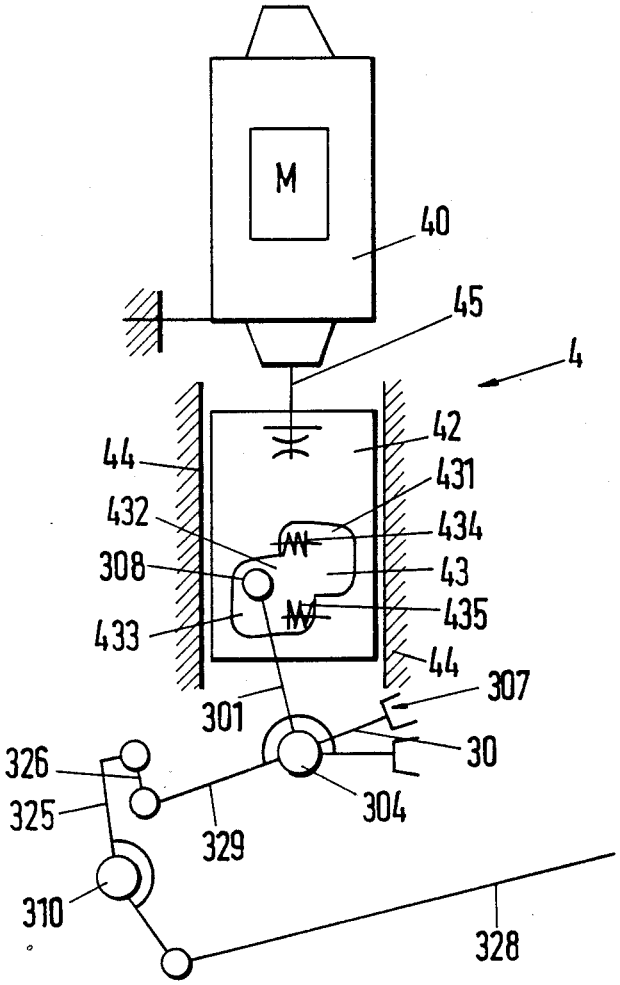
FIG. 7 illustrates a diagrammatic view of a modified weft change motion constructed in accordance with the invention.

Referring to FIG. 7, wherein like reference characters indicate like parts as above, the actuating means to counteract the inertia of the links 326 and weft segment 30 may be in the form of a locking device 4. In this case, the locking device 4 includes a slide block 42 which is movable by means of a magnet 40 and connecting rod 45 into a plurality of positions. As indicated, the slide block 42 has a slot 43 having a plurality of zones 431, 432, 433, corresponding to the positions of the slide block 42. In addition, a slide pin 308 is mounted within the slot 43 and is connected to the mixer segment 30 by means of the bracket 301.

Depending upon the position of the slide block 42, the pin 308 may move in different patterns. For example, in the position shown, the pin 308 is able to reciprocate so as to permit pivoting of the mixer element between the end positions thereof. In this case, the weft yarns 9*a*, 9*b* are transferred alternately and one at a time to a projectile 93 (see FIG. 3).

When the magnet 40 acts by way of the rod 45 to lower the slide block 42, the slide pin 308 moves only in the top zone 431 of the slot 43. Consequently, the range of movement of the segment 30 is reduced to less than half of the normal movement associated with pure weft mixer operation. In this state, only one weft yarn 9*b* is picked for a number of weaving cycles. Conversely, when the magnet 40 raises the block 42 completely, only the weft yarn 9*a* is picked for a number for picks so that the slide pin 308 can move only in the lowermost zone 433 of the slot 43. Thus, the link 326 can reciprocate only between the bottom position and the position immediately before the neutral position thereof.

As indicated, the slide block 42 is movable within a suitable guide 44 of the loom.

In addition, compression springs 434, 435, are provided in the respective upper and lower zones 431, 433 of the slot 43 in order to abut the pin 308 during the movement of the mixing lever 325.

Figure 8:
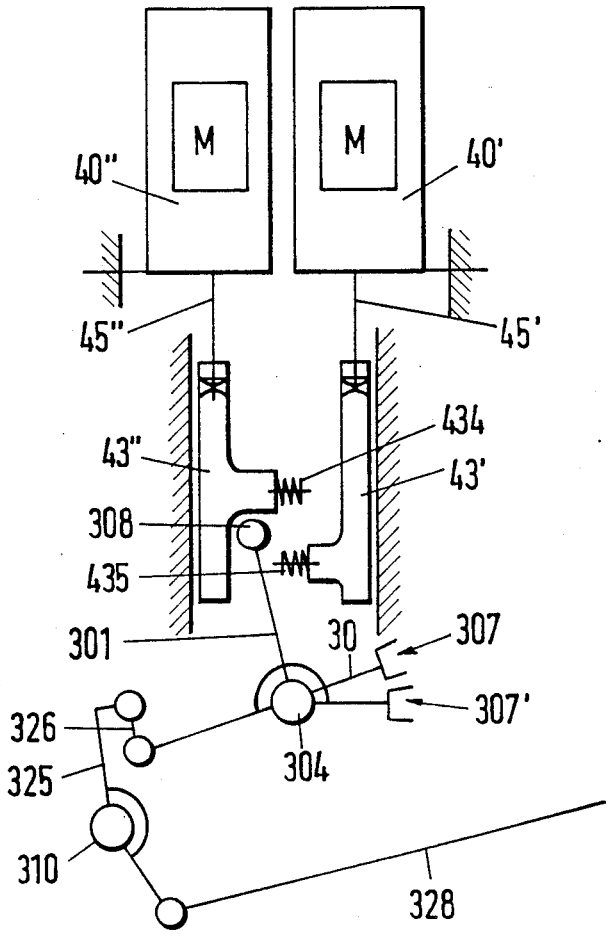
FIG. 8 illustrates a diagramatic view of a further modified weft change motion similar to the embodiment of FIG. 7.

Referring to FIG. 8, wherein like reference characters indicate like parts as above, the locking device may be formed by a pair of slide blocks 43', 43" which are movable into a plurality of positions relative to each other to define a plurality of zones corresponding to these positions. As indicated, each block 43', 43" is connected by a connecting rod 45', 45" to a magnet 40', 40" which provide means for moving the blocks independently of each other between the respective positions.

Of note, the compression springs 434, 435 facilitate the reversal of movement of the mixer segment 30.

Referring to FIGS. 9*a* and 9*b*, slide blocks 42*a*, 42*b* may be provided with slots of different shapes, as illustrated. As the shapes are self-explanatory, no further description is believed to be warranted.

Referring to FIG. 9*c*, a slide block 42*c* may be provided with a disc 46*c* which is rotatably mounted in the slide block 42*c* and which is provided with an opening 43*c* to receive a pin (not shown). In this case, the disc 46c can be rotated depending upon the position of the slide block. To this end, reference is made to FIGS. 10a, l 10b, and 10c.

As illustrated in FIG. 10c, the opening is of T-shape so as to have a relatively long slot and a relatively short perpendicular slot for receiving a pin 308 at the end of the bracket 301. During pure weft mixer operation in a 1:1 ratio, i.e. picking alternately between weft yarn 9a and weft yarn 9b, the slide pin 308 moves from one possible end position to the other in the relatively long slot in the cisc 46c. When the magnet 40 (see FIG. 7) raises the slide block 42c by a reduced amount Δh, the slide pin 308 presses on the bottom contour of the relatively long slot in the disc 46c and pivots the disc 46c counter-clockwise as indicated by the arrow in FIG. 10b. Consequently, the disc 46c is rotated in to the position shown in FIG. 10c. At this time, the pin 308 is impeded from further motion to the right, as viewed. If the stroke Δh is chosen appropriately, the disc 46c rotates approximately through 90° into the position shown in FIG. 10c. The bracket 301 is thus able to cover only half the maximum possible pivot angle and is prevented from further pivoting since the slide pin 308 engages the base of the slot. Thereafter, the slide pin 308 can move only to the left.

In order to restore the original position shown in FIG. 10c, the slide block 42c is lowered oy a reduced amount Δh' shortly before the slide pin 308 engages the contour of the long slot in the disc 46c so that the place at which the pin 308 engages is disposed above the fulcrum of the disc. Consequently, the disc is pivoted back again through a 90° angle so that the bracket 308 can oscillare into the left-hand end position shown in FIG. 10a.

Correspondingly, the disc 46c can be moved into a position at a 180° offset from that shown in FIG. 10c, that is, into the position shown in FIG. 9d if the raising of the slide block 42c occurs during pivoting of the bracket 301 from right to left as viewed in FIG. 10a.

Referring to FIG. 9e, the disc 46e may be formed with an opening of.triangular shape so as to accommodate the movements produced by the T-shaped opening of FIG. 10a. Likewise, as seen in FIG. 9f, the opening may be of an elongated arcuate shape for similar purposes.

The embodiments illustrated in FIGS. 9c to 9f enable the magnet power to be reduced since the magnet requires only a very limited stroke to move the slide blocks which are used with the illustrated discs.

Referring to FIG. 11, the weft change motion may be constructed to operate a 4-color changer similar to that as described in U.S. Pat. No. 3,528,459. In this embodiment, two parallel-operating actuating means 32a, 32b act on a balance lever 35 in order to effect pivoting of the mixer segment 30 on a pivot shaft. In this respect, the lever 35 is connected on the input side by way of a pivotally connected link 33a, 33b to each oscillating link 326a, 326a and on the output side to the mixer segment 30. As indicated, a second actuating means 4a, 4b is connected via a two-armed lever 30a, 30b to the links 33a, 33b. The invention thus provides a weft change motion which has relatively few components and which operates without internal impact stresses. In addition, the second actuating means which acts as a locking device for impeding motion of the oscillating levers can be made of very light weight construction since these locking devices are lightly loaded.

What is claimed is:

1. A weft change motion for a loom comprising first means for selectively moving one of at least two weft givers into a picking position;

an actuating means reciprocally mounted between a pair of end positions; and a connector interconnected to and between said actuating means and said first means for transferring a moving force from said actuating means to said first means, said connector being disposed to move into and through a neutral position during movement of said actuating means between said end positions thereof.

2. A weft change motion as set forth in claim 1 wherein said first means includes a mixer segment pivotally mounted about a pivot axis and having said weft givers mounted therein, said segment being pivoted about said axis between two positions.

3. A weft change motion as set forth in claim 2 wherein said connector is a link pivotally connected on a first pivot axis to said actuating means and pivotally connected on a second pivot axis to said mixer segment, said first and second axes being disposed in a common plane with said pivot axis of said segment in said neutral position of said link.

4. A weft change motion as set forth in claim 3 which further comprises a second actuating means pivotally connected to said mixer segment to counteract the inertia of said link and said segment at least at said neutral position of said link for positioning said segment for a return movement into one of said two positions thereof in response to a subsequent movement of said first actuating means.

5. A weft change motion as set forth in claim 3 which further comprises a second actuating means pivotally connected to said link for positioning said segment for a movement into one of said two posirions thereof in response to a subsequent movement of said first actuating means.

6. A weft change motion as set forth in claim 4 wherein said second actuating means includes at least one controllable magnet effective in two directions.

7. A weft change motion as set forth in claim 4 wherein said second actuating means includes a slide block movable into a plurality of positions and having a plurality of zones corresponding to said positions thereof, and a slide pin secured to said mixer segment and guided within a selected zone of said slide block to inhibit movement of said segment from one position thereof to the other position thereof while permitting movement therebetween in a third position of said slide block.

8. A weft change motion as set forth in claim 6 wherein said second actuating means includes a rotatable disc mounted in said slide block and having slots to define said zones, said slide pin being slidably disposed in at least one of said slots.

9. In a weft change motion for a loom, the combination comprising a pivotally mounted mixer segment having at least two weft givers mounted thereon, said segment being pivoted about a pivot axis to move a selected one of said weft givers into a picking position;

an actuating means reciprocally mounted between a pair of end positions; and a link pivotally connected to and between said actuating means and said mixer segment for transferring a moving force from said actuating means to said mixer segment to move said mixer element about said pivot axis, said link being disposed to move into and through a neutral position during movement of said actuating means between said end positions thereof.

10. The combination as set forth in claim 9 which further comprises a second actuating means connected to one of said link and said segment to selectively apply a force thereto with said link in said neutral position sufficient to impede continued movement of said weft segment about said pivot axis.

11. The combination as set forth in claim 10 wherein said second actuating means includes a double acting magnet having a reciprocally mounted armature connected to said mixer segment.

12. The combination as set forth in claim 9 which further comprises a slide block movable into a plurality of positions and having a slot with a plurality of zones corresponding to said positions, a slide pin slidably mounted in said slot in one of said zones and connected to said mixer segment whereby in one of said zones, said pin impedes pivoting of said mixer segment from a first position thereof; in a second zone said pin impedes pivoting of said mixer element from a second position thereof; and in a third zone, said pin permits pivoting of said mixer element between said positions thereof.

13. The combination as set forth in claim 12 wherein said block has a first compression spring in said first zone for abutting of said pin thereon during movement of said actuating means with said pin in said first zone and a second compression spring in said second zone for abutting of said pin thereon during movement of said actuating means with said pin in said second zone.

14. The combination as set forth in claim 12 which further comprises means for moving said block between said positions thereof.

15. The combination as set forth in claim 9 which further comprises a pair of slide blocks movable into a plurality of positions relative to each other to define a plurality of zones corresponding to said positions, a pin disposed in one of said zones and connected to said mixer segment whereby in one of said zones, said pin impedes pivoting of said mixer segment from a first position thereof; in a second zone said pin impedes pivoting of said mixer element from a second position thereof; and in a third zone, said pin permits pivoting of said mixer element between said positions thereof.

16. The combination as set forth in claim 15 wherein one of said blocks has a compression spring in said first zone for abutting of said pin thereon during movement of said actuating means with said pin in said first zone and the other of said blocks has a compression spring in said second zone for abutting of said pin thereon during movement of said actuating means with said pin in said second zone.

17. The combination as set fortn in claim 15 which further comprises means for moving said blocks independently of each other between said positions.

18. The combination as set forth in claim 9 which further comprises a slide block movable into a plurality of positions, a disc rotatably mounted in said slide block and having an opening therein, and a pin disposed in said opening and connected to said mixer element, said opening being shaped to permit reciprocal movement of said pin therein with said block in one position to permit pivoting of said mixer segment between a first position thereof and a second position thereof, to impede movement of said pin in one direction with said block in a second position to prevent pivoting of said mixer segment from said first position thereof, and to impede movement of said pin in an opposite direction with said block in a third position to prevent pivoting of said mixer segment from said second position.

19. The combination as set forth in claim 18 wherein said opening is T-shaped.

20. The combination as set forth in claim 18 wherein said opening is of triangular shape.

21. The combination as set forth in claim 18 wherein said opening is of elongated accurate shape.

* * * * *

UNITED STATES PATENT AND TRADEMARK OFFICE

CERTIFICATE OF CORRECTION

PATENT NO. : 4,936,355

DATED : June 26, 1990

INVENTOR(S) : FRANTISEK JANKOVSKY

It is certified that error appears in the above-identified patent and that said Letters Patent is hereby corrected as shown below:

Column 2, line 66 change "diagramatic" to -diagrammatic-
Column 4, line 3 change "23" to -323-
Column 5, line 58 change "is not" to -not- Column 7, line 11 change "cisa" to -disc-
Column 7, line 27 change "oy: to -by-
Column 8, line 36 change "posirions" to -positions-

Signed and Sealed this

Nineteenth Day of November, 1991

*Attest:*

HARRY F. MANBECK, JR.

*Attesting Officer*

*Commissioner of Patents and Trademarks*